US012790092B2

(12) United States Patent
Flé

(10) Patent No.: US 12,790,092 B2
(45) Date of Patent: Nov. 10, 2026

(54) DEVICE FOR PACKAGING A DOSE OF A SOLID OR PASTY PRODUCT PLACED IN A RESERVOIR

(71) Applicant: A.2.C, Puymoyen (FR)

(72) Inventor: Jérôme Flé, Saint-Saturnin (FR)

(73) Assignee: A.2.C, Puymoyen (FR)

( * ) Notice: Subject to any disclaimer, the term of this patent is extended or adjusted under 35 U.S.C. 154(b) by 243 days.

(21) Appl. No.: 18/574,009

(22) PCT Filed: Jun. 23, 2022

(86) PCT No.: PCT/FR2022/051225
§ 371 (c)(1),
(2) Date: Dec. 23, 2023

(87) PCT Pub. No.: WO2022/269197
PCT Pub. Date: Dec. 29, 2022

(65) Prior Publication Data

US 2024/0367881 A1 Nov. 7, 2024

(30) Foreign Application Priority Data

Jun. 23, 2021 (FR) ..... 2106714

(51) Int. Cl.
*B65D 75/58* (2006.01)
*A45D 40/00* (2006.01)
*B65D 51/32* (2006.01)

(52) U.S. Cl.
CPC ..... *B65D 75/5833* (2013.01); *A45D 40/0087* (2013.01); *B65D 51/32* (2013.01)

(58) Field of Classification Search
CPC ..... B65D 75/5833; B65D 75/5811; A45D 40/0087; A45D 2200/1036; A45D 2200/10; A45D 34/02; G09F 5/04
USPC .... 206/581, 823, 484; 428/40.2, 905, 321.5; 132/320, 317
See application file for complete search history.

(56) References Cited

U.S. PATENT DOCUMENTS 3,809,483 A * 5/1974 Young ..... A47L 23/10 206/229
4,824,143 A * 4/1989 Grainger ..... A45D 40/0087 283/56
4,876,136 A * 10/1989 Chang ..... A45D 40/0087 206/823

(Continued)

FOREIGN PATENT DOCUMENTS

EP 3729994 11/2021

OTHER PUBLICATIONS

International Search Report for International Application No. PCT/FR2022/051225 dated Dec. 16, 2022, 3 pages.

(Continued)

*Primary Examiner* — Steven A. Reynolds
(74) *Attorney, Agent, or Firm* — TraskBritt

(57) ABSTRACT

A device for packaging a dose of a solid or pasty product placed in a reservoir formed in a case. The device includes at least three laminated layers placed on top of each other. The laminated layers include two outer layers and at least one intermediate layer sandwiched between the two outer layers, at least one of the intermediate layer(s) having a layer corresponding to the section of the reservoir. A solid or pasty product is deposited in the layer covered by the second outer layer.

11 Claims, 6 Drawing Sheets

(56) References Cited

U.S. PATENT DOCUMENTS 4,889,755 A * 12/1989 Charbonneau ..... A45D 40/0087 428/905
4,890,872 A * 1/1990 Parrotta ..... G09F 23/10 206/823
4,923,063 A * 5/1990 Tararuj ..... B65D 75/5833 206/484
5,037,139 A * 8/1991 Schoenleber ..... B42D 1/007 206/823
5,050,910 A * 9/1991 Schechter ..... B42D 1/007 283/105
5,242,521 A * 9/1993 Hibsch ..... B42D 15/00 283/105
5,295,580 A * 3/1994 Hicks ..... B65D 5/5054 229/87.02
5,445,821 A * 8/1995 Brown ..... A61Q 13/00 428/905
5,568,866 A * 10/1996 Grosskopf ..... B65D 75/30 206/823
6,301,860 B1 * 10/2001 Gunderman ..... A45D 40/0087 53/410
6,691,872 B1 * 2/2004 Berman ..... G09F 5/04 206/581
9,974,375 B2 * 5/2018 Dobler ..... A45D 37/00
2002/0195465 A1 * 12/2002 Duquet ..... A45D 34/02 222/143
2006/0045607 A1 * 3/2006 Thiebaut ..... A45D 40/26 401/6
2006/0075964 A1 * 4/2006 Habatjou ..... A45D 40/0087 118/506
2013/0015258 A1 * 1/2013 Boyles ..... A61L 9/042 239/6
2016/0100670 A1 * 4/2016 Dobler ..... B65D 75/5855 206/484.2
2016/0113377 A1 4/2016 Moussion et al.
2020/0337438 A1 * 10/2020 Naso ..... A45D 40/0087

OTHER PUBLICATIONS

International Written Opinion for International Application No. PCT/FR2022/051225 dated Dec. 16, 2022, 7 pages.

* cited by examiner

DEVICE FOR PACKAGING A DOSE OF A SOLID OR PASTY PRODUCT PLACED IN A RESERVOIR

CROSS-REFERENCE TO RELATED APPLICATIONS

This application is a national phase entry under 35 U.S.C. § 371 of International Patent Application PCT/FR2022/051225, filed Jun. 23, 2022, designating the United States of America and published as International Patent Publication WO 2022/269197 A2 on Dec. 29, 2022, which claims the benefit under Article 8 of the Patent Cooperation Treaty of French Patent Application Serial No. 2106714, filed Jun. 23, 2021.

TECHNICAL FIELD

The present disclosure relates to a method for manufacturing the packaging of individual doses of solid or pasty products allowing mass-scale low-cost industrial manufacturing, for example, for the production of a sampling case for cosmetic, food, or industrial products or even the production of single-use pill containers.

BACKGROUND

Different types of packaging are known in the state of the art for individual or pasty individual doses, for example, in the form of a blister pack, formed by an assembly of a thermoformed plastic layer backed by a metal or cardboard layer.

The thermoformed transparent layer is generally a rigid layer of PVC or PET, which makes it possible to see what is being purchased. This blister is either:

Bonded onto a piece of cardboard, also called a stiffener,

Welded onto another blister or onto a plastic layer,

Stapled onto a support, usually made of printed cardboard.

Packages are also formed by flexible cases.

In the prior art, patent application EP3729994 is known, which relates to a device for sampling perfume comprising a reservoir in the form of a case having two outer walls facing one another intended to receive an applicator in the form of a strip, at least one of the faces of the strip and/or the inner face of at least one of the outer walls of the case containing a fragrant substance, the applicator further comprising a gripping means connected to the strip and fully emerging from the reservoir, the applicator being free of means for temporarily connecting to the walls of the case, characterized in that the case has an intermediate wall sandwiched between two outer walls, the intermediate wall having a pre-cut in the shape of the strip.

This solution is not suitable for the sampling of cream or solid material because the two outer faces completely enclose the strip and prevent the removal of a substance filling the reservoir.

U.S. Pat. No. 4,889,755 is known, describing a device for sampling liquid materials comprising:

(a) two sheets that form a closed zone, (b) a removable strip is present at least in part inside the closed zone, having on at least part of at least one surface thereof microcapsules and a binder material, the microcapsules containing a liquid. This strip is attached by adhesive to at least one sheet inside the closed zone.

Patent US2006/075964 describes a device for packaging and applying at least one product, in particular, a cosmetic product, comprising a support comprising a fibrous material, a cavity intended to contain the product, and an applicator comprising a portion produced by partial cutting of the support and integral therewith at least before use.

The solutions of the prior art are adapted to protect an applicator impregnated with a vaporizable substance, but not to transfer a viscous or solid material.

Indeed, the solutions known, in particular, by patent EP3729994 provide that the applicator fills the entire volume between the two outer sheets, which prevents adding any sampled material, and allows only the diffusion of a substance impregnating the applicator, and optionally the outer sheets.

BRIEF SUMMARY

In order to address these disadvantages, the present disclosure generally relates to a device for packaging a dose of a solid or pasty product placed in a reservoir formed in a case. The case is formed by a superposition of layers comprising two outer layers arranged on either side of at least one intermediate layer. The two outer layers and the at least one intermediate layer have a cut-out respectively delimiting a main body and a transverse complementary body forming a gripping tab. The two outer layers and the at least one intermediate layer have, between the main body and the complementary body, respectively, a transverse frangible line. The two outer layers are solid elements, and the two outer layers and the at least one intermediate layer are superimposed and laminated together. The transverse body of at least one of the intermediate layer(s) has an extension forming a stopper. The frangible line is interrupted on either side of the extension. The at least one of the intermediate layer(s) has a cut-out delimiting a reservoir for receiving a solid, liquid or pasty substance, surrounded by an inner edge of the extension and a peripheral zone in a shape of a "U," the tabs of which are connected to the transverse body by the frangible line. An inner surface of the two outer layers adjacent to the at least one intermediate layer is not bonded to the zone corresponding to the reservoir.

Preferably, the device for packaging a dose of a solid or pasty product consists exclusively of cut layers of cardboard assembled by bonding.

Advantageously, at least one of the intermediate layers has a line of weakness corresponding to the section of at least one reservoir. At least one second intermediate layer has a line of weakness delimiting at least one reserve corresponding to at least one flat stopper extended by a gripping shoulder extending outside the protrusion, the at least one reserve being connected to the intermediate layer by attachment points.

According to one embodiment, the outer layers have a transverse line of weakness between a zone forming the wall of the body of the device and a zone corresponding to the gripping shoulder.

According to another embodiment, the reserve corresponding to a flat stopper extended, on the side opposite the gripping shoulder, by a blade, the shape of which corresponds to the shape of the window forming the at least one reservoir.

According to yet another embodiment, the plurality of reserves corresponding to a plurality of flat stopper extended, on the side opposite the gripping shoulder, by blades, the shape of which corresponds to the shape of the window forming the at least one reservoir.

Preferably, the window is extended by a cut-out of the same width as the window, for the removal without scraping of the pasty product deposited on the blade, the cut-out extending to the transverse line of weakness.

According to one embodiment, at least one of the intermediate layers has cut-outs delimiting a reservoir, and in that at least one of the outer layers has a line of weakness delimiting a zone superimposed on the cut-outs when it is superimposed on the intermediate layer, the line of weakness extending to an edge of the outer layer to form a tab, the surface of the outer layer not being bonded to the surface of the intermediate layer inside the line of weakness except at a transverse line.

According to another aspect, the present disclosure proposes a method for manufacturing devices for packaging individual doses of solid or pasty products placed in a reservoir formed in a case having two outer layers and at least one intermediate layer sandwiched between the two outer layers, the at least one intermediate layer having a window of the reservoir, characterized in that it comprises the following steps:

a) Preparing pre-cut strips having a plurality of zones corresponding to the outer layers and to the at least one intermediate layer,
b) Laminating a solid strip forming the outer layers with at least one strip forming the at least one intermediate layer,
c) Depositing a solid or pasty product in each of the chambers defined by a window of the at least one intermediate layer,
d) Closing the superimposition of the intermediate strip with a solid strip to form the second outer layer,
e) Cutting into the assembly thus formed of individual packages.

According to one embodiment, the steps a) and b) are carried out during a first sequence, and steps c), d) and e) are carried out during a second sequence.

According to another embodiment, the steps a) and b) are carried out during a first sequence, steps c) and d) are carried out during a second sequence, and step e) is carried out in a third sequence.

According to yet another aspect, the present disclosure proposes an automated equipment for manufacturing devices for packaging individual doses of solid or pasty products placed in a reservoir formed in a case having two outer layers and at least one intermediate layer sandwiched between the two outer layers, the at least one intermediate layer having a pre-window of the reservoir, characterized in that it comprises:

a) At least three rollers of pre-cut strips each having a plurality of zones corresponding to the outer layers and to the at least one intermediate layer,
b) At least one station for bonding a solid strip forming the outer layers with at least one strip forming the at least one intermediate layer,
c) At least one station for filling each of the chambers, defined by a window of the at least one intermediate layer, with a solid or pasty product,
d) Another bonding station for closing the superposition of the intermediate strip with a solid strip to form the second outer layer,
e) A station for cutting into the assembly thus formed of individual packages.

Preferably, the automated equipment for manufacturing devices for packaging individual doses of solid or pasty products comprises a sheet-by-sheet unstacking system.

BRIEF DESCRIPTION OF THE DRAWINGS

The present disclosure will be better understood from reading the detailed description of non-limiting exemplary embodiments shown by the appended drawings, in which.

DETAILED DESCRIPTION

Figure 1:
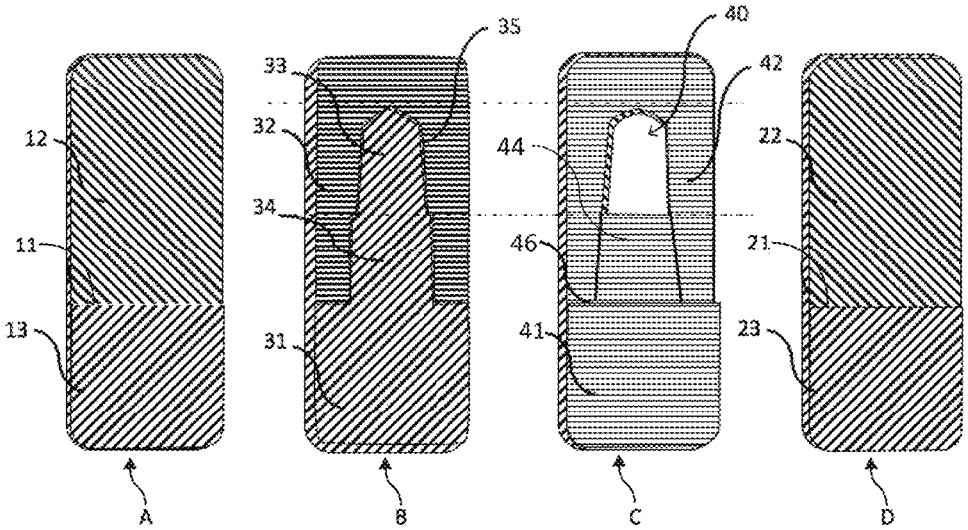
FIG. 1 shows a top view of the four layers (A to D) of a first example embodiment.

The present disclosure is based on the production of packaging devices, preferably, single-material and more particularly cardboard, by assembling two solid outer layers A, D and an intermediate layer C cut to define the lateral contour of a reservoir whose main faces will be formed by the solid surfaces of the outer layers A, D. This reservoir forms a thin volume, having the thickness of the intermediate layers, and having a cross-section corresponding to the shape of the cut-out(s) of the intermediate layers. A solid, powdered or pasty substance may be deposited in this cut before the closure by the second outer layer.

This reservoir (40) is extended by a cut-out zone forming a stopper, which is connected to a transverse body forming a gripping tab.

This gripping tab is provided both on the outer layers A, D and on the intermediate layer(s) B, C. The outer layers A, D have a frangible line between this transverse body and the complementary part forming the main body; to make it possible, by exerting longitudinal traction, to separate the two bodies.

The intermediate layers B, C have a transverse body separated from the complementary part by two frangible line segments between which the transverse body extends longitudinally by a laterally cut-out part forming a stopper. The part complementary to this stopper is formed by a rim having a general "U" shape, connected to the transverse body by the frangible line segments.

The main intermediate layer C has, on the side opposite the transverse body, the cut-out forming the reservoir (40), surrounded by the "U"-shaped part. The two outer layers A, D and the intermediate layer C, and optionally the additional intermediate layer B, are superimposed and laminated at the transverse bodies and the "U"-shaped rims to form a lower multilayer block, forming the body of the device, and an upper multilayer block forming a gripping tab. The presence of frangible lines makes it possible to separate these two blocks by pulling longitudinally. The extension of the intermediate layer C forms a stopper, which is driven with the block forming the gripping body.

Optionally, the second intermediate layer B has a cut-out of the same shape as the cut-out surrounding the reservoir (40) of the main intermediate layer C, but this cut-out is not recessed but is at least partially solid, and forms a strip, one of the surfaces of which is open on the reservoir (40) and thus allows the removal of the contents from the reservoir.

"Layer" is understood to mean a stratum, for example, a cardboard or aluminum or plastic sheet, for example, or one made of a composite material, for example, a sheet of nonwoven material or paper or cardboard coated with a sealing or decorative film.

The assembly can be done from individual elements, superimposed to prepare the packages one after the other by superimposing the constituent layers onto one packaging before starting the manufacturing of the next one.

The cut-outs corresponding to the intermediate layers and to the two outer layers can be placed in unstackers to feed a "pick and place" robot that successively takes an outer layer, one or more intermediate layers, a solid product and finally a second solid layer. Alternatively, a nozzle deposits a pasty product into the aperture (45) of the intermediate layer.

This configuration also optionally allows industrial manufacture from rolls of cardboard forming a strip two being intended to form the first and last solid layer and one or more rollers having a pre-cut strip to form the intermediate layer(s). The strips forming the first solid layers and the intermediate layers, coming from these rollers are superimposed and glued. The solid or pasty product is then deposited in the cut-out zone in the intermediate layer defining the reservoir, before closing the assembly with the second solid layer coming from the corresponding roller.

Access to the content can be done according to primarily two alternatives:

Either by an opening provided on one of the solid outer layers, for example, by partial tearing, drilling, or by a precut flap, or a notch temporarily closed by a detachable part to open up access to the reservoir and more generally by any means making it possible to create an opening in a layer;

Or by an opening provided in the edge of one of the intermediate layers, which is temporarily closed by a detachable part of the intermediate layer.

In the latter case, one of the intermediate layers can define an applicator formed by a blade extending in the cut-out zone to define the section of the reservoir, this blade being extended by a gripping shoulder accessible by, for example, a cut-out formed in the solid outer layers or a partial gluing of the solid layers onto the shoulder of the intermediate layer, precut or embrittlement lines making it possible to detach the part forming the gripping shoulder from the other part forming the body with the reservoir.

First Exemplary Embodiment

FIGS. 1 to 3 and FIG. 11 relate to a first example embodiment in the form of a packaging of pasty cosmetic samples, for example, lipstick, with a detachable applicator. FIG. 1 illustrates top views of the two solid outer faces (A, D) and the two intermediate faces (B, C).

This sampling packaging is in the form of a case with or without applicator to be extracted. The body of the packaging is provided with a cavity making it possible to package the makeup (lipstick, eyeshadow, blush, cream, powder, mascara, etc.) or food product (spread, granules, powder, etc.) for direct or indirect application or tasting by the consumer. Access to the cavity is done either by manual extraction of the applicator housed inside the case or optionally by opening the outer layer.

In the described example, the sample consists of four laminated layers (or more).

These layers may be of different thicknesses, preferably, consisting of paper, cardboard, or optionally plastic or aluminum complex, for example, cardboard sheets with a thickness of 0.2 to 10 millimeters of rectangular shape, for example, with cut-outs made by a cutting tool or any other known means. For greater thicknesses, it is possible to take either a thicker cardboard or to stack multiple sheets.

The four layers (A to D) are cut into the same rectangular shape, which in the described example has rounded corners. They are cut into cardboard sheets of the same thickness or a first thickness for the outer layers (A, D) and an optionally greater thickness for the intermediate layers (B, C).

The external layers (A, D) have a separation line (11, 21) delimiting a body (12, 22) and a gripping tab (13, 23). This separation line (11, 21) is completely cut, or formed by a perforated cut, or a cut-out preserving frangible connecting bridges (100), when pulled to separate the gripping tab (13, 23) from the body (12, 22) for example.

The first intermediate layer B has a cut-out delimiting the contour of a gripping tab (31) connected by frangible bridges (100) to a complementary part (32) defining the contour of the reservoir. This intermediate layer B is optional, in particular, in the case where the device is intended to contain a substance that will be extracted not using an applicator, but by being expelled through the opening formed by the recess of the stopper extending the transverse body of the intermediate layer C.

The gripping tab (31) has dimensions that correspond to the gripping tabs (13, 23) of the outer layers (A, D). This gripping tab (31) is extended by a convergent rectangular or trapezoidal part defining a neck (34) opening onto the reservoir (40). This neck (34) is extended by a blade (33) entirely surrounded by the complementary part (32).

The second intermediate layer C has a cut-out defining an aperture (45) whose shape corresponds to the section of the reservoir (40). It has a cut-out delimiting the contour of a gripping tab (41) connected by frangible bridges (100) to a complementary part (42) defining the contour of the reservoir (40).

The gripping tab (41) has dimensions that correspond to the gripping tabs (13, 23) of the outer layers (A, D) and to the gripping tab (31) of the first intermediate layer. This gripping tab (41) is extended by a convergent rectangular or trapezoidal part defining a neck (44) extended by a tip (43) the end of which is cut to form an aperture (45). Unlike the first intermediate layer B, the applicator and the body (140) are not completely complementary, the aperture (45) forming a gap extending between the tip (43) and the body (140).

The second intermediate layer C thus has a cut defining an aperture (45) whose shape corresponds to the section of a reservoir wherein a pasty or solid substance can be deposited, to form a stratum having a thickness corresponding to that of the second intermediate layer C.

The blade (33) is surrounded by a complementary part (32) defining the body surrounding the reservoir. This complementary part (32) can be directly adjacent to the blade (33) and simply separated by a cut line (35) having breakable bridges. It can also be separated by a cut-out of any shape defining the contour of a part of the reservoir.

Figure 2:
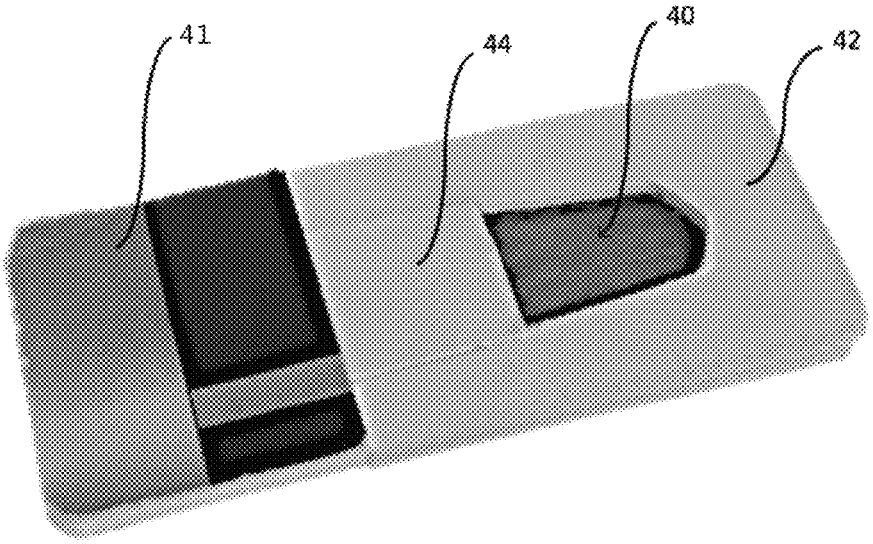
FIG. 2 shows a perspective view of the assembly of the first three layers of the first example embodiment.

The first three layers A to C are superimposed and assembled by gluing to form a reservoir that opens upward as shown in FIG. 2. The next step consists of depositing a pasty sample in the aperture (45) of the applicator, before applying the last solid layer D onto the intermediate layer C.

Optionally the aperture (45) can extend to the separation line (46) in order to allow the removal of the applicator without scraping the sample, or on the contrary have a neck (44) extending between the edge of the cut-out defining the aperture (45) and the separation line (46), in order to limit the quantity of pasty product removed from the reservoir during the extraction of the applicator.

Figure 3:
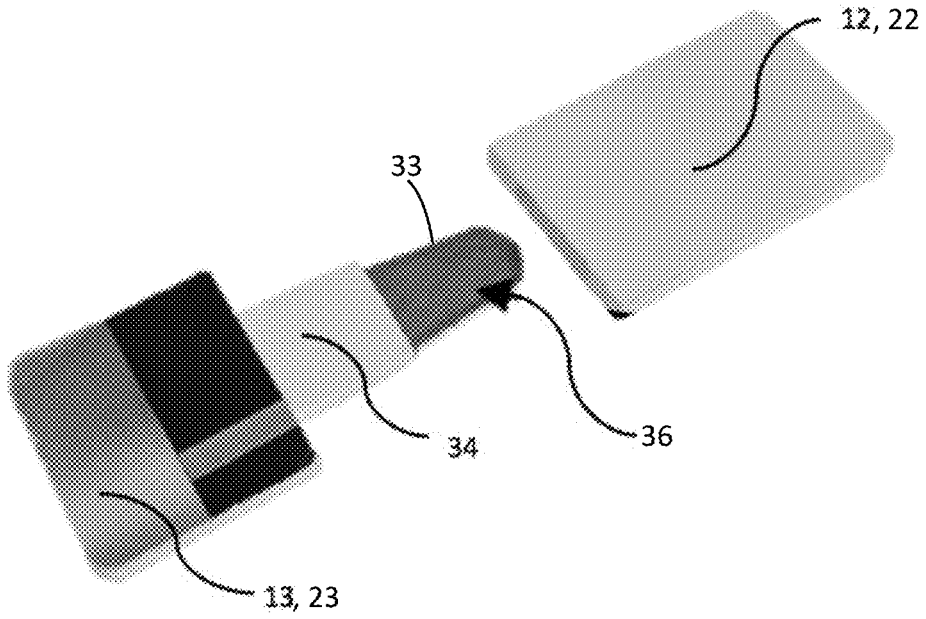
FIG. 3 shows a perspective view of a cosmetic packaging device according to a first example embodiment.

FIG. 3 shows the view of the applicator extracted from the assembly formed by the superposition of the four layers A, B, C, and D. The applicator has a thick gripping shoulder formed by the superposition of the four layers, extended by a neck (34) ensuring the closing of the neck opening onto the reservoir, as well as the guiding of the applicator when entering or exiting the case, and an active zone loaded with a sample (36) of product, allowing it to be applied.

Operation

The operation of this first example embodiment is as follows:

During the manufacture of the packaging, the four layers A, B, C and D are prepared, the external cut of which is identical, and whose internal cut-outs are configured:

- For the two outer layers A, D: a transverse cutting line to delimit a first part forming a gripping tab (13, 23) and a second part forming the body (12, 22), the two parts being connected by frangible bridges (100).
- For the first intermediate layer B: a substantially U-shaped precut line delimiting, by a cutting line and frangible bridges:
  - A first solid and non-divisible part defining a gripping tab (31), longitudinally extended by a strip, the first part of which forms a sealing neck (34), and the second part forms the blade (33), which serves as the support of the sampled substance.
  - A second solid and non-divisible complementary part (32) to the first solid part, the complementary part (32) corresponding to the body (130) of the sample dispenser.
- For the second intermediate layer C: a substantially U-shaped precut line delimiting by a cutting line and frangible bridges:
  - A first solid and non-divisible part defining a gripping tab (41), longitudinally extended by a strip, the first part of which forms a sealing neck (44), and an end of the second part forms the tip (43), the end of which is cut away to form an aperture (45).
  - A second solid and non-divisible complementary part 42, corresponding to the body (140) of the sample dispenser.

The two intermediate layers have the same frangible cut-out, and differ only by the fact that, for the second intermediate layer C, the strip has at its end a cut-out defining an aperture (45) while for the first intermediate layer, this strip including the neck (34) and the blade (33) extends to the inner edge of the body (130).

FIGS. 4 to 8 show pieces of cardboard for the production of sample dispensers as described herein.

In order to manufacture a sample dispenser, the first intermediate layer B is adhered to the outer layer A, over the entire surface of the gripping tab (31) and the complementary part (32), the neck (34) and blade (33) (the lighter part in FIG. 11) corresponding to the strip not being laminated.

The second intermediate layer C is then deposited on the first intermediate layer B, by bonding all of the adjacent surfaces, including the adjacent surfaces of the strips. An assembly is then obtained having an aperture (45) corresponding to the cut-out of the blade (33) at the end of the strip of the second intermediate layer C.

The pasty or solid sample is then deposited in this aperture (45) so that it covers the blade (33) at the end of the strip of the first intermediate layer B, ensuring that the sample layer is not thicker than the second intermediate layer C.

Finally, the other outer layer D is deposited onto the second intermediate layer C by bonding only the gripping tab (41), and leaving the lighter part of the second intermediate layer C unbonded.

The case thus produced preserves the sample enclosed in the aperture (45).

When the gripping tab formed by the superposition of the four layers ABC and FIG. 1D is pulled while the opposite end of the case is held in place, the frangible bridges (100) are torn, and an applicator is extracted with, for the gripping tab, four thicknesses, and at the strip, two thicknesses and, at the end, a single thickness coated with the sample, which was able to be extracted through the channel released by the removal of the two strips.

Second Exemplary Embodiment

FIGS. 4 to 8 show pieces of cardboard for the mass-production of a cosmetic product sample applicator device, for example, a lipstick. These are cardboard sheets with a thickness of 0.2 to 10 millimeters, rectangular in shape, for example, with cut-outs made by a cutting tool or any other known means. For greater thicknesses, it is possible to take either a thicker cardboard or to stack multiple sheets.

Figure 4:
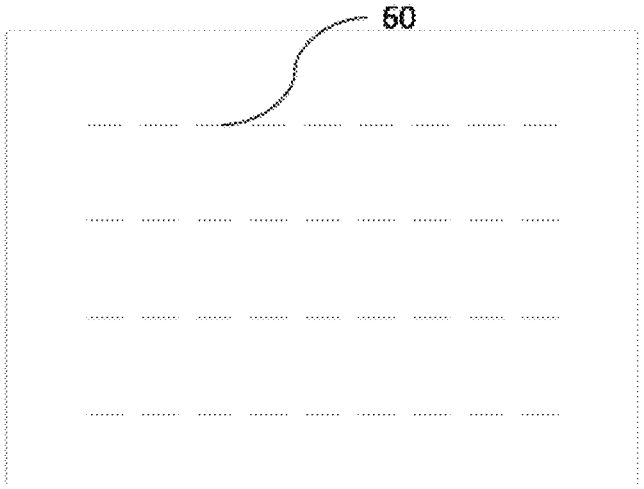
FIG. 4 shows a top view of the sheet for the first outer layers of a cosmetic packaging device according to a second embodiment.
Figure 5:
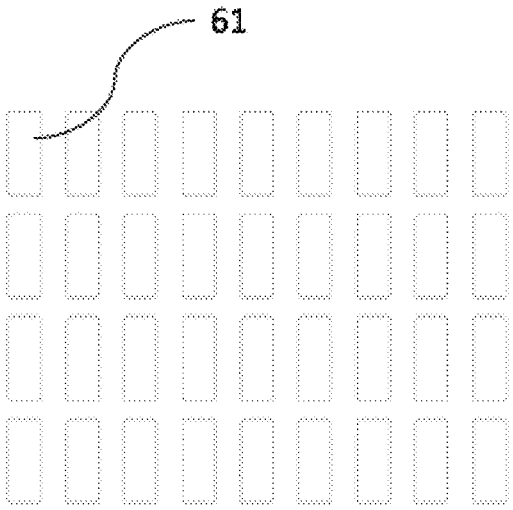
FIG. 5 shows a top view of the piece of cardboard showing the final cut of the 4 laminated sheets.
Figure 6:
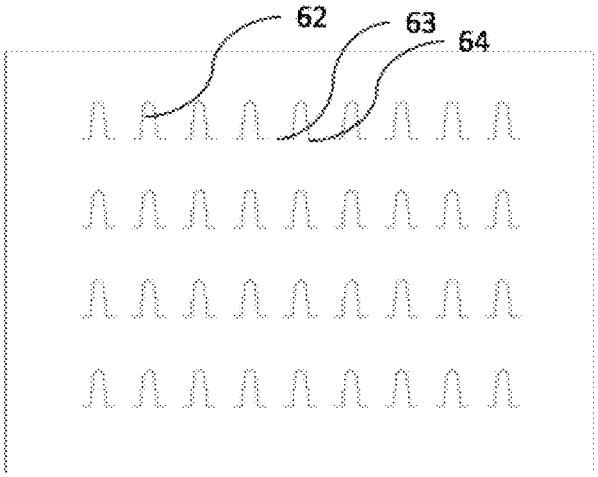
FIG. 6 shows a top view of the piece of cardboard for the second intermediate layers of a cosmetic packaging device according to a second example embodiment.
Figure 7:
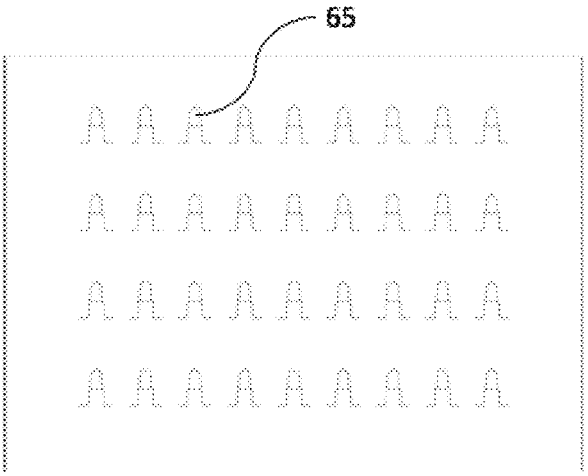
FIG. 7 shows a top view of the piece of cardboard for the third intermediate layers of a cosmetic packaging device according to a second example embodiment.

FIG. 5 shows a top view of the cardboard board representing the final cut-out of the four laminated sheets according to FIGS. 4, 5, 6, 7 and 8.

Figure 8:
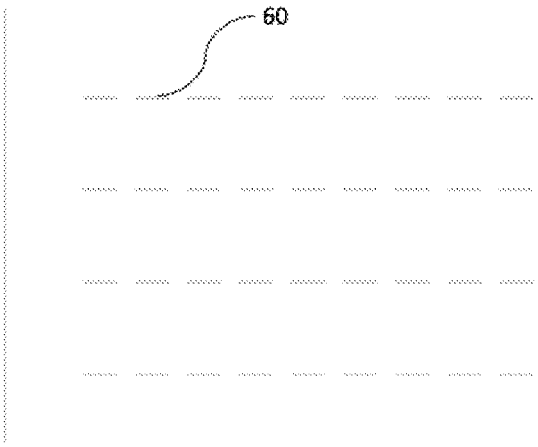
FIG. 8 shows a top view of the piece of cardboard for the second outer layers of a cosmetic packaging device according to a second example embodiment.

The two pieces shown in FIGS. 4 and 8 are identical and correspond to the outer layers. They have linear cut-outs (60, 61, 62, 63, 64, 65). However, for certain particular designs, the two outer sheets may also have different configurations.

Third Exemplary Embodiment

Figure 9:
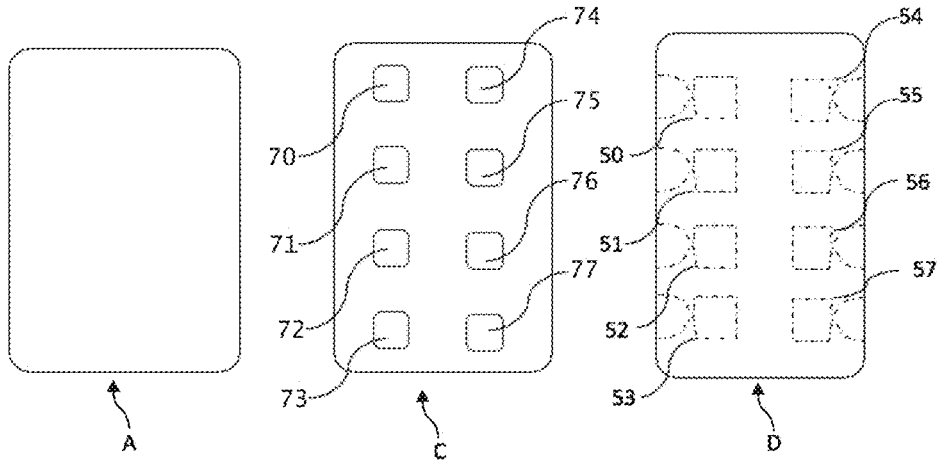
FIG. 9 shows a top view of three layers (A, C, D) of a packaging device according to a second embodiment.

FIG. 9 shows another example embodiment, for example, a pill container application.

The pill container according to the present disclosure has reservoirs formed in a case characterized in that it consists of the superposition of at least three laminated layers, comprising two outer layers (A, D) and at least one intermediate layer (B, C) sandwiched between the two outer layers (A, D), an intermediate layer (C) having two columns of cut-outs (70 to 77) corresponding to the section of the reservoir.

To increase the volume of the reservoirs, it is possible to superpose multiple intermediate layers having the same cut-outs, or optionally cut-outs of increasing cross-section to form flared reservoirs.

Before closing with the solid layer (D), a tablet, a pill, a sachet and more generally one or more medicinal products in solid form are deposited in each reservoir.

After filling, a second outer layer (D) is bonded.

This second outer layer (D) has lines of weakness (50 to 57) delimiting an unbonded zone (apart from a transverse line), comprising a tab extending to the edge of the layer (D) extending a flap whose surface is slightly smaller than that of the cut-outs (70 to 77) so as to preserve a bonded edge. The unbonded transverse line is located between the part forming the tab, and the flap. It ensures the sealing of the reservoir. Its width is determined to nevertheless allow the flap to be driven when a user lifts the tab despite the bonded line.

Fourth Exemplary Embodiment

Figure 10:
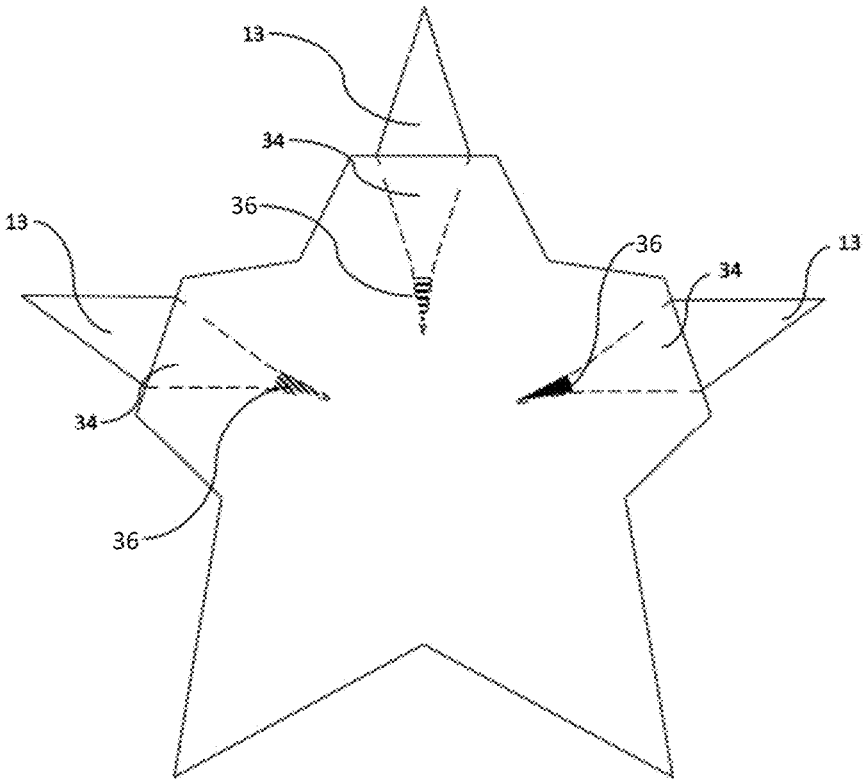
FIG. 10 shows another example embodiment, for a multi-sample tester application.
Figure 11:
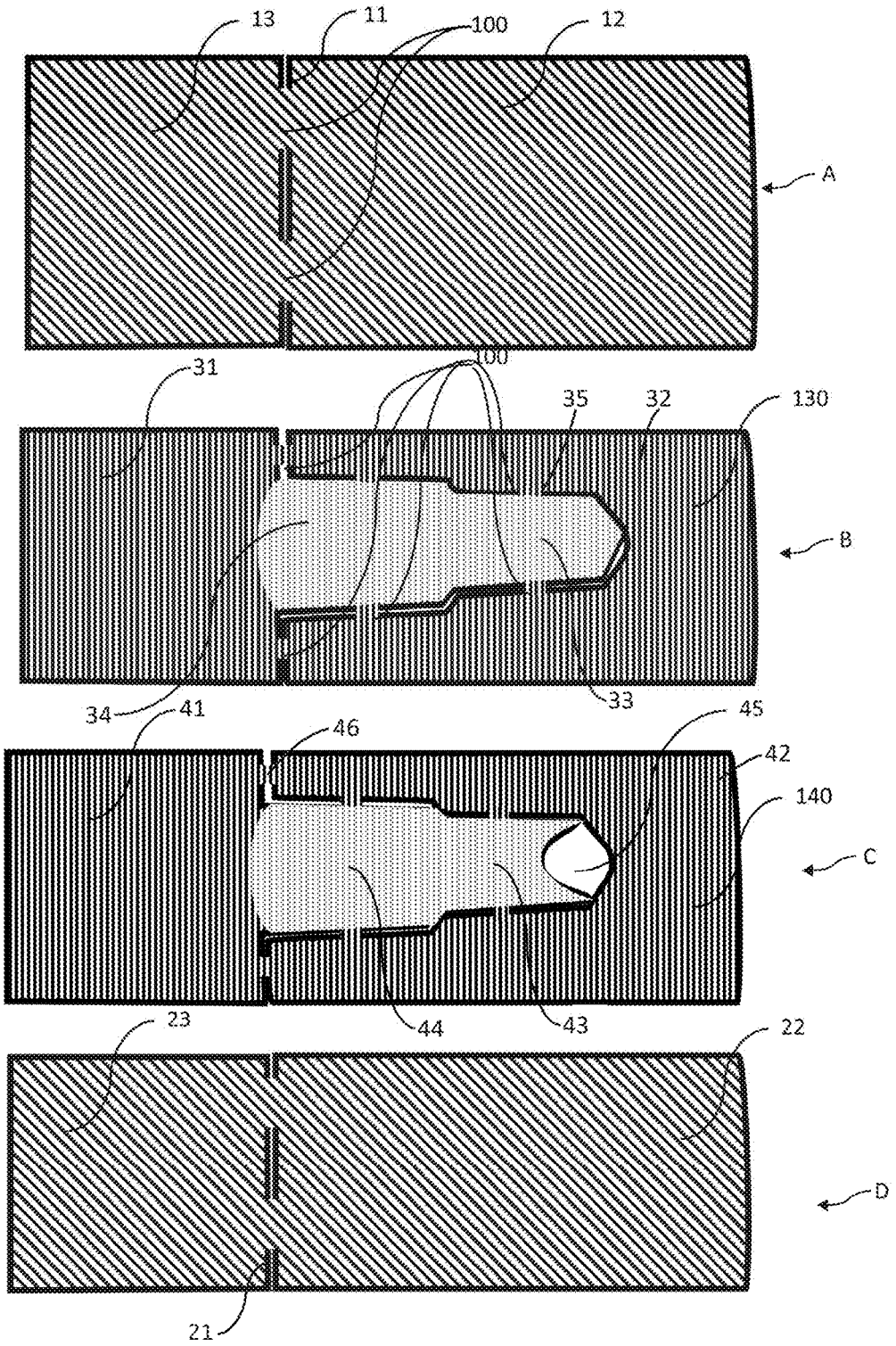
FIG. 11 shows another top view of the four layers (A to D) of a first example embodiment.

FIG. 10 shows another example embodiment, for a multi-sample tester application. The intermediate cut-out has a plurality of reserves for the formation, on the same case, of several blades (33) each bearing a sample (36) of a particular pasty composition, each extended by a neck (34) and by a gripping tab (13).

The invention claimed is:

1. A device for packaging a dose of a solid, liquid or pasty product placed in a reservoir formed in a case formed by a superposition of layers comprising two outer layers arranged on either side of at least one intermediate layer, the two outer layers each comprising a main body and a gripping tab, the two outer layers having, between the main body and the gripping tab, respectively, a transverse frangible line, the two outer layers being solid elements, the two outer layers and the at least one intermediate layer being superimposed and laminated together, wherein the at least one intermediate layer comprises a first intermediate layer having an extension extending from the gripping tab and forming a stopper, the first intermediate layer having a cut-out delimiting a reservoir for receiving a solid, liquid or pasty substance, adjacent an inner edge of the extension and a peripheral zone in a shape of a "U," the first intermediate layer having a gripping tab portion forming a portion of the gripping tab, the gripping tab portion connected to the peripheral zone by a weakness line, and wherein an inner surface of each of the two outer layers is not bonded to the first intermediate layer in a zone corresponding to the extension.

2. The device of claim 1, wherein the at least one intermediate layer comprises a second intermediate layer having another extension adjacent the extension of the first intermediate layer, the another extension of the second intermediate layer including a portion adjacent the reservoir, the another extension being delimited by a cut-out separating the another extension from another peripheral zone in the shape of a "U" of the second intermediate layer, the second intermediate layer having another gripping tab portion forming another portion of the gripping tab, the another peripheral zone being connected to the another gripping tab portion by another weakness line.

3. The device of claim 1, wherein the device consists essentially of cut-out cardboard layers.

4. The device of claim 1, wherein each of the transverse frangible lines is between a zone thereof forming the main body of the device and a zone forming the gripping tab of the device.

5. The device of claim 2, wherein the another extension of the second intermediate layer comprises a neck extended on a side thereof opposite the gripping tab by a blade, the blade including the portion of the another extension adjacent the reservoir.

6. The device of claim 2, wherein the extension and the another extension together form a flat stopper extended, on a side thereof opposite the gripping tab, by the portion of the another extension adjacent the reservoir.

7. The device of claim 5, wherein a lateral width of the neck is greater than a width of the blade.

8. The device of claim 1, wherein the at least one intermediate layer has cut-outs each delimiting a respective reservoir, and wherein at least one of the two outer layers has lines of weakness delimiting zones superimposed on the cut-outs, the lines of weakness extending up to an edge of the at least one of the two outer layers to define gripping tabs between the edge and the reservoir, the surface of the at least one of the two outer layers not being bonded to at least a portion of the surface of the at least one intermediate layer inside the lines of weakness adjacent the reservoirs.

9. A device for packaging a dose of a substance, comprising:

a first planar outer layer of material;

a second planar outer layer of material; and at least one planar intermediate layer of material disposed between the first planar outer layer of material and the second planar outer layer of material, the at least one planar intermediate layer of material including at least one aperture;

wherein the first planar outer layer of material, the second planar outer layer of material, and the at least one planar intermediate layer of material are stacked and bonded together to form a laminated stack;

each of the first planar outer layer of material, the second planar outer layer of material, and the at least one planar intermediate layer of material having a gripping tab portion that together defining a gripping tab;

wherein the at least one planar intermediate layer of material includes an extension extending from the gripping tab portion thereof to the aperture, the extension being separated from a main portion of the at least one intermediate layer by a line of weakness to allow the extension to be separated from the main portion of the at least one planar intermediate layer of material, at least a portion of the extension not being bonded to the first planar outer layer of material and the second planar outer layer of material; and wherein another line of weakness extends between the gripping tab and another portion of the laminated stack to allow the gripping tab and the extension of the at least one planar intermediate layer of material to be separated from the laminated stack and provide access to a reservoir within the laminated stack defined by the aperture of the at least one planar intermediate layer.

10. The device of claim 9, wherein each of the first planar outer layer of material, the second planar outer layer of material, and the at least one planar intermediate layer of material comprise cardboard.

11. The device of claim 9, further comprising another planar intermediate layer of material disposed between the first planar outer layer of material and the second planar outer layer of material, the another planar intermediate layer of material including a gripping tab portion forming a part of the gripping tab, the another planar intermediate layer of material including another extension extending from the gripping tab portion of the another planar intermediate layer of material, the another extension being separated from a main portion of the another intermediate layer by an additional line of weakness to allow the another extension to be separated from the main portion of the another planar intermediate layer of material, at least a portion of the another extension not being bonded to the first planar outer layer of material and the second planar outer layer of material, the another extension including having a portion thereof adjacent the reservoir.

* * * * *